US005137684A

United States Patent [19]

Fritzemeier

[11] Patent Number: 5,137,684

[45] Date of Patent: Aug. 11, 1992

[54] HYDROGEN EMBRITTLEMENT RESISTANT STRUCTURAL ALLOY

[75] Inventor: Leslie G. Fritzemeier, West Hills, Calif.

[73] Assignee: Rockwell International Corporation, Seal Beach, Calif.

[21] Appl. No.: 665,062

[22] Filed: Mar. 6, 1991

[51] Int. Cl.[5] ..... C22C 38/48; C22C 38/50

[52] U.S. Cl. ..... 420/54; 420/586

[58] Field of Search ..... 420/54, 586, 584

[56] References Cited

U.S. PATENT DOCUMENTS

| | | | |
|---|---|---|---|
| 3,663,213 | 5/1972 | Eiselstein et al. | 420/43 |
| 4,066,447 | 1/1978 | Smith, Jr. et al. | 420/79 |
| 4,165,997 | 8/1979 | Smith, Jr. et al. | 420/59 |

*Primary Examiner*—Deborah Yee

*Attorney, Agent, or Firm*—H. Fredrick Hamann; Harry B. Field; David C. Faulkner

[57] ABSTRACT

A precipitation hardening, high strength alloy, characterized by a low, controlled co efficient of thermal expansion and resistance to hydrogen environment embrittlement.

3 Claims, No Drawings

HYDROGEN EMBRITTLEMENT RESISTANT STRUCTURAL ALLOY

BACKGROUND OF THE INVENTION

1. Field of the Invention

The present invention relates to an iron-nickel-chromium containing alloy wherein the ratios of nickel and chromium to iron, and the contents of the elements niobium, titanium and aluminum, are controlled to provide resistance to hydrogen environment embrittlement, high strength and moderate oxidation and corrosion resistance for elevated temperature service in hydrogen fueled rocket engine environments.

2. Description of Related Art

It is well known that alloys of iron, nickel and cobalt can be produced to provide high strength at elevated temperatures in severe environments. While nickel-based, iron-based and cobalt-based alloys can be produced to provide resistance to oxidation and hot corrosion, controlled coefficients of thermal expansion, high strength and good long time stability, an alloy exhibiting both resistance to hydrogen environment embrittlement and resistance to oxidation and corrosion has not been demonstrated. For rocket propulsion applications, especially for hydrogen fueled engine systems, these attributes are highly desirable. Resistance to hydrogen environment embrittlement allows the elimination of costly schemes for protecting hydrogen embrittlement susceptible materials from the hydrogen environment. Good strength in the temperature regime up to approximately 1200° F. is required. Moderate resistance to oxidation and corrosion is required, primarily due to intermittent exposure to oxidizing atmospheres. The successful alloy for these applications must also be capable of being welded without deleterious microstructural changes.

Previous efforts to produce alloys for elevated temperature use have focussed on applications in the aircraft gas turbine or automotive industries.

U.S. Pat. No. 4,165,997 discloses an iron-nickel-chromium alloy incorporating at least columbium and titanium elements to provide a heat and corrosion resistance alloy, exhibiting strength retention, ductility, and resistance to oxidation.

U.S. Pat. No. 4,066,447 describes a low expansion nickel-iron alloy incorporating alluminum, titanium and other trace elements to insure satisfactory characteristics of thermal expansion coefficient, inflection temperature, yield strength and the like, where operating temperatures become elevated above 500° F.

U.S. Pat. No. 3,663,213 describes a nickel-chromium-iron alloy wherein the nickel and iron contents are controlled to produce a strong age-hardening effect.

However, none of the alloys disclosed in the aforementioned U.S. patents are formulated such that they exhibit acceptable high hydrogen environment embrittlement resistance as well as corrosion and oxidation resistance.

Accordingly, it is an object of the present invention to provide a heat resistance alloy exhibiting high hydrogen environment embrittlement resistance as well as corrosion and oxidation resistance.

Another object of the present invention resides in a precipitation hardening, high strength alloy, characterized by a low, controlled coefficient of thermal expansion.

It is a further object of the present invention to provide heat resistant wrought articles such as plate, sheet, strip and forgings.

Another object is to provide articles in the form of castings.

Still another object is to provide articles which may be welded or joined without deleterious microstructural changes. cl SUMMARY OF THE INVENTION In accordance with the present invention, there is provided a heat, embrittlement, corrosion, and oxidation resistance alloy comprising, in weight percent, 35.0 nickel, 10.0 chromium, 2.0 niobium, 1.0 aluminumm, and 1.0 titanium and the balance iron.

According to the present invention, niobium, alluminum and titanium levels have been adjusted in order to maintain strength and to avoid deleterious phase formation which decreases producibility and causes weld microfissuring.

DETAILED DESCRIPTION OF THE PREFERRED EMBODIMENT

The present invention relates to an alloy having enhanced hydrogen environment embrittlement resistance as well as corrosion and oxidation resistance. This alloy comprises by weight, no more than 5% cobalt, 30–35% nickel, 1–2% niobium, 0.7–1.0% aluminum and 0.5–1.4% titanium, with the balance iron. The ratio of iron to nickel plus chromium plus cobalt is maintained at 1:1 to 1.5:1 in order to maintain hydrogen environment embrittlement resistance. Carbon and boron contents are maintained at low levels in order to provide resistance to weld zone microfissuring. Carbon content is controlled to less than 0.02% by weight and boron content is less than 0.002%. All other elements are controlled to trace levels consistent with the best practices of the superalloy melting industry.

The alloy is typically produced by vacuum induction melting a master heat from virgin materials. The vacuum induction melted ingot is vaccum arc remelted and reduced to final product (plate, sheet forging) through standard hot working practices. No special handling requirements have been identified. Master alloy to be used for the production of cast articles is vaccum induction melted and then remelted directly for pouring of the cast articles. Casting demonstrations have shown that the alloy is readily castable and that no special handling beyond the standard practices for superalloy castings is required.

This alloy is age hardenable and provides good strength retention up to about 1200° F. The alloy is typically solution heat treated and then age hardened in a two step process. A reasonable temperature range for solution heat treatment is between 1700° F. and 1800° F. for 0.25 to 1.0 hours. The solution heat treatment temperature must be above the gamma prime solvus temperature of approximately 1650° F.

Age hardening heat treatment temperatures for the current alloy are in the range of from 1150° F. to 1375° F., dependent on the form of the product to be heat treated. A typical cycle for a wrought plate product is 1325° F./8 hours, furnace cool to 1150° F., hold 8 hours and air cool to room temperature. The final heat treatment to be employed (solution plus age) is a function of the product form and configuration of the final part.

The following example is provided to give a further understanding of the preferred compositions and desired properties achieved by this invention.

EXAMPLE

The alloy (heat) listed in Table I as alloy 87 is one preferred composition for an alloy exhibiting the preferred characteristics described by this invention. The alloy comprises, in approximate weight percents, 35% nickel, 10% chromium, 0% cobalt, 2.00% niobium, 1.00% aluminum and 1.00% titanium, the balance is predominantly iron with some additional trace elements. The alloys in Table I were vacuum induction melted and vacuum arc remelted in small heats, homogenized and then rolled to 0.5" thick plate. The plates were aged at 1325° F./8 hours, furnace cooled to 1150° F., held for 8 hours and air cooled to room temperature. Tensile testing was subsequently conducted in high pressure hydrogen environment and in an inert environment to evaluate resistance to hydrogen environment embrittlement. Susceptibility to hydrogen environment embrittlement is measured as the ratio of ductility in hydrogen to ductility in helium or the ratio of the notched bar ultimate tensile strength in hydrogen relative to helium. An unaffected material will exhibit ratios near 1.0.

TABLE I

| | Alloy compositions, major elements in weight percent (Highlighted Elements Indicate Comparison Points) | | | | | | | |
|---|---|---|---|---|---|---|---|---|
| Heat | Fe | Ni | Co | Cr | Nb | Al | Ti | C |
| 91 | Bal | 30.01 | 10.0 | 10.34 | 2.01 | 0.99 | 1.04 | .009 |
| 90 | Bal | 34.98 | 4.99 | 10.17 | 1.04 | 1.00 | 1.04 | .008 |
| 88 | Bal | 30.02 | 0.01 | 14.93 | 2.06 | 1.02 | 1.01 | .007 |
| 87 | Bal | 34.95 | 0.01 | 9.93 | 2.00 | 1.00 | 1.00 | .007 |
| 89 | Bal | 34.83 | 0.01 | 9.89 | 1.97 | 0.72 | 1.37 | .008 |
| 86 | Bal | 34.99 | 0.01 | 9.87 | 1.05 | 0.71 | 1.39 | .005 |
| 85 | Bal | 34.92 | 0.01 | 9.97 | 2.97 | 0.70 | 0.48 | .011 |
| 83 | Bal | 35.22 | 0.01 | 9.98 | 1.98 | 0.99 | 0.49 | .006 |
| 84 | Bal | 35.08 | 0.01 | 10.02 | 0.97 | 0.99 | 0.49 | .006 |

Results of the smooth bar tensile testing in 5000 psi hydrogen and helium environments at room temperature are presented in Table II. Notched bar tensile tests results are presented in Table III. Comparison of the relevant ratios indicates that several of the alloys exhibit excellent resistance to hydrogen environment embrittlement. Alloy number 87 exhibited the highest overall room temperature strengths with good ductility. In addition to these attributes, alloy number 87 has been found to exhibit oxidation and corrosion resistance similar to other chromium containing iron-nickel based alloys which are not hydrogen resistant. Alloy number 87 has been shown amenable to processing as plate, sheet and forgings and also as a cast product.

TABLE II

| | Smooth Bar Tensile Test Results | | | | | | | |
|---|---|---|---|---|---|---|---|---|
| | Yield Strength (ksi) | | Ultimate Strength (ksi) | | Elongation (%) | | R of A (%) | |
| Heat | H2 | He | H2 | He | H2 | He | H2 | He |
| 91 | 142 | 140 | 183 | 182 | 17.1 | 19.2 | 39.6 | 47.8 |
| 90 | 132 | 136 | 171 | 171 | 17.1 | 18.4 | 39.4 | 39.4 |
| 88 | 143 | 139 | 185 | 184 | 15.6 | 19.2 | 32.1 | 54.0 |
| 87 | 147 | 148 | 188 | 189 | 17.9 | 16.0 | 40.6 | 34.1 |
| 89 | 146 | 141 | 186 | 178 | 18.1 | 18.4 | 37.6 | 30.7 |
| 86 | 138 | 133 | 176 | 175 | 18.7 | 18.0 | 40.9 | 35.4 |
| 85 | 135 | 138 | 171 | 178 | 15.2 | 19.6 | 28.4 | 49.3 |
| 83 | 130 | 133 | 170 | 169 | 16.5 | 15.2 | 41.4 | 40.0 |
| 84 | 99 | 104 | 128 | 138 | 10.4 | 18.4 | 20.4 | 28.0 |

TABLE III

| | Notched Bar Tensile Test Results | |
|---|---|---|
| | Ultimate Strength (ksi) | |
| Heat | H2 | He |
| 91 | 258 | 271 |
| 90 | 239 | 247 |
| 88 | 227 | 272 |
| 87 | 266 | 272 |
| 89 | 257 | 281 |
| 86 | 263 | 263 |
| 85 | 242 | 259 |
| 83 | 255 | 255 |
| 84 | 227 | 228 |

What is claimed is:

1. An alloy comprising, in weight percents, 30–35% nickel, 9–10% chromium, less than 5% cobalt, 1–2% niobium, 0.7–1.0% aluminum and 0.5–1.4% titanium; the balance iron, with the further requirement that the ratio of iron to nickel plus chromium plus cobalt is maintained between 1:1 to 1.5:1.

2. An alloy according to claim 1 which exhibits resistance to hydrogen environment embrittlement and resistance to oxidation and corrosion.

3. An alloy according to claim 1 with yield strength greater than 120,000 psi.

* * * * *